US010163616B2

(12) United States Patent
Verenchikov et al.

(10) Patent No.: US 10,163,616 B2
(45) Date of Patent: Dec. 25, 2018

(54) MULTI-REFLECTING TIME-OF-FLIGHT ANALYZER

(71) Applicant: LECO Corporation, St. Joseph, MI (US)

(72) Inventors: Anatoly N. Verenchikov, St. Petersburg (RU); Mikhail I. Yavor, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 15/521,486

(22) PCT Filed: Oct. 23, 2014

(86) PCT No.: PCT/US2014/061936
§ 371 (c)(1),
(2) Date: Apr. 24, 2017

(87) PCT Pub. No.: WO2016/064398
PCT Pub. Date: Apr. 28, 2016

(65) Prior Publication Data

US 2017/0338094 A1 Nov. 23, 2017

(51) Int. Cl.
*H01J 49/00* (2006.01)
*H01J 49/40* (2006.01)
*H01J 49/06* (2006.01)

(52) U.S. Cl.
CPC ..... *H01J 49/406* (2013.01); *H01J 49/067* (2013.01)

(58) Field of Classification Search
CPC ..... H01J 49/406; H01J 49/067
(Continued)

(56) References Cited

U.S. PATENT DOCUMENTS

2006/0214100 A1* 9/2006 Verentchikov ..... H01J 49/406 250/287
2007/0176090 A1 8/2007 Verentchikov
(Continued)

FOREIGN PATENT DOCUMENTS

DE 102010062529 A1 7/2013
GB 2455977 A 7/2009
(Continued)

OTHER PUBLICATIONS

International Search Report dated Jun. 18, 2015, relating to International Application No. PCT/US2014/061936.
(Continued)

*Primary Examiner* — Michael Maskell
(74) *Attorney, Agent, or Firm* — Honigman Miller Schwartz and Cohn LLP

(57) ABSTRACT

A multi-reflecting time-of-flight mass spectrometer comprises a pair of parallel aligned ion mirrors and a set of periodic lenses for confining ion packets along the drift z-direction. To compensate for time-of-flight spherical aberrations T|zz created by the periodic lenses, at least one set of electrodes are disposed within the apparatus, forming an accelerating or reflecting electrostatic fields which are curved in the z-direction in order to form local negative T|zz aberration. The structure may be formed within an accelerator, within flinging fields or intentionally and locally curved fields of ion mirrors, within electrostatic sector interface, or at curved surface of ion to electron converter at the detector.

14 Claims, 5 Drawing Sheets

(58) Field of Classification Search
USPC ..... 250/281, 282, 287
See application file for complete search history.

(56) References Cited

U.S. PATENT DOCUMENTS

| | | | | |
|---|---|---|---|---|
| 2011/0168880 | A1* | 7/2011 | Ristroph ..... | H01J 49/406<br>250/282 |
| 2011/0186729 | A1 | 8/2011 | Verentchikov | |
| 2013/0068942 | A1 | 3/2013 | Verenchikov | |

FOREIGN PATENT DOCUMENTS

| | | | |
|---|---|---|---|
| JP | 2000036282 | A | 2/2000 |
| JP | 2008535164 | A | 8/2008 |
| WO | 2006098086 | A1 | 9/2006 |
| WO | WO-2014074822 | A1 | 5/2014 |

OTHER PUBLICATIONS

Japanese Office Action for related Application No. 2017-518083 dated Feb. 27, 2018.
"German Office Action for the related application No. 112014007095.5 dated Jun. 20, 2018."

* cited by examiner

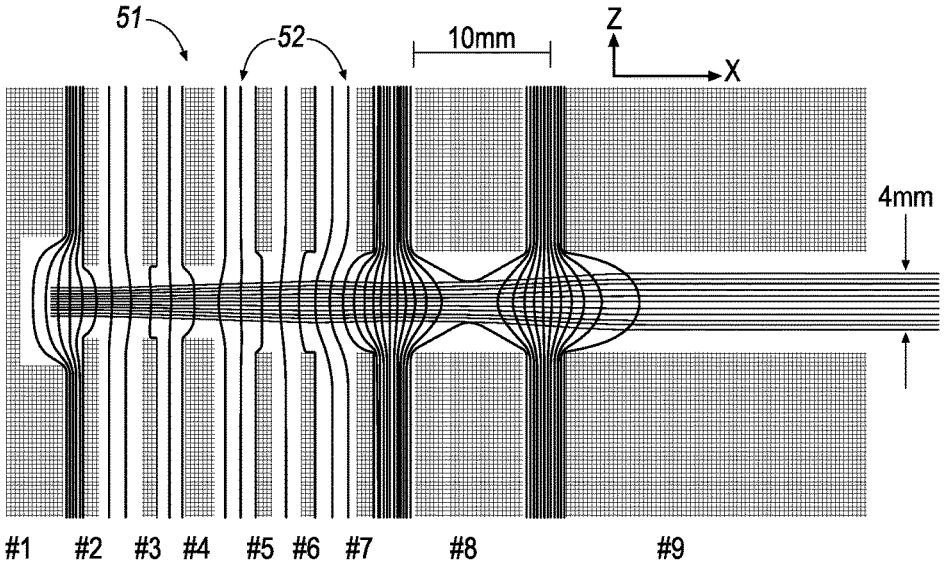
FIG. 5
Table 1
| Electrode # | 1 | 2 | 3 | 4 | 5 | 6 | 7 | 8 | 9 |
|---|---|---|---|---|---|---|---|---|---|
| Voltage, V | 0 to 1650 pulsed | 0 | 0 to -655 pulsed | 0 to -1230 pulsed | -1950 | -2450 | -3105 | -6400 | -3105 |
FIG. 5A
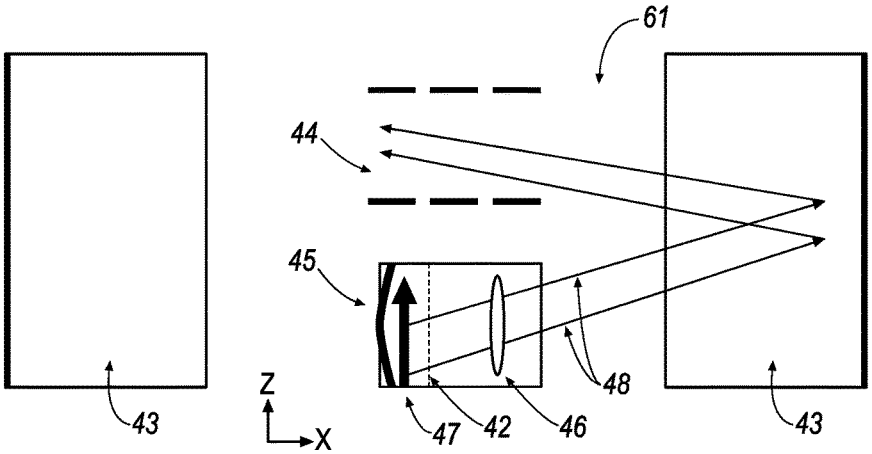
FIG. 6

MULTI-REFLECTING TIME-OF-FLIGHT ANALYZER

CROSS REFERENCE TO RELATED APPLICATION

This Application is a National Stage Application of International Application No. PCT/US2014/0161936, filed on Oct. 23, 2014, which is entirely incorporated herein by reference.

TECHNICAL FIELD

The disclosure relates to the field of mass spectroscopic analysis, such as multi-reflecting time-of-flight mass spectrometry apparatuses and a method for using multi-reflecting time-of-flight mass spectrometry apparatuses.

BACKGROUND

Time-of-flight mass spectrometry is a widely used tool of analytical chemistry, characterized by a high speed of analysis in a wide mass range. Multi-reflecting time-of-flight mass spectrometers (MR-TOF MS) enable substantial increases in resolving power due to the flight path extension. Such flight path extension requires the folding of ion path trajectories. Reflecting the ions in mirrors is one method for accomplishing the folding of ion paths. UK Patent No. GB2080021, by inventor H. Wollnikas, appears to have disclosed the potential for utilizing mirrors to reflect ions. The deflection of ions in sector fields provides a second method for accomplishing the folding of ion paths. This second method appears to have been disclosed in a 2003 scholarly article attributed to Japan's Osaka University. See Michisato Toyoda et al., *Multi-Turn Time-of-Flight Mass Spectrometers with Electrostatic Sectors,* 38 J. Mass Spectrometry 38 1125 (2003). Of these two methods for folding ion paths, mirror-type MR-TOF MS, due to their high-order time per energy focusing, allow for larger energy acceptance, which is an important advantage.

As far back as 1989, an advanced scheme of folded-path MR-TOF MS using two-dimensional (planar) gridless mirrors was known. The Russian Patent No. SU 1725289, by Nazarenko et. al., appears to have utilized this scheme, which is illustrated in the present FIG. 1. The planar mass spectrometer by Nazarenko provides no ion focusing in the z-direction; thus, essentially limiting the number of reflection cycles.

The present inventors, in Publication No. WO2005001878, appear to have disclosed a set of periodic lenses in the field-free region between the planar ion mirrors to confine ion packets in the drift z-direction. The present FIG. 2 illustrates a MR-TOF MS utilizing these periodic lenses.

The present inventors, in UK Publication No. GB2476964, appear to have disclosed curved ion mirrors in the drift z-direction forming a hollow cylindrical electrostatic ion trap, further extending the ion flight path within a MR-TOF MS.

Increasing the flight path length in the MR-TOF MS causes three distortions (aberrations) to the flight time (TOF), each of which limit the mass resolving power. The three aberrations are: (i) ion energy spread, (ii) spatial spread of ion packets in the y-direction, and (iii) spatial spread of ion packets in the z-direction. The z-directional spatial spread aberrations are primarily the second order TOF aberrations ("T|zz") referred as the "spherical" aberration. A spherical aberration is created by periodic lenses confining the ion beam in the z-direction and is always positive (T|zz>0).

The present inventors, in Publication No. WO2013063587, appear to disclose an improvement to the ion mirror isochronicity with respect to energy and y-spread. Thus, T|zz aberrations caused by the periodic lenses remain the major remaining TOF aberration limiting the mass resolving power of the MR-TOF MS.

To reduce those T|zz aberrations, the present inventors, in U.S. Patent Application No. 2011186729, appear to disclose a quasi-planar ion mirror comprising, in essence, a spatially and periodically modulated ion mirror field as illustrated in FIG. 3. The spatially modulated ion mirror field provides for negative T|zz aberration, thus compensating for the positive T|zz caused by the periodic lenses utilized in MR-TOF MS.

Even so, numerical simulations of MR-TOF MS with quasi-planar ion mirrors show that such mirrors achieve efficient elimination of TOF aberrations only if the period of the electrostatic field inhomogeneity in the z-direction equals or exceeds the y-height of the mirror window. Hence, in the field of MR-TOF MS, practical analyzer sizes continue to limit the density of ion trajectory folding and the flight path extension. What is more, the fact that periodic modulation affects y-components of the field and complicates the analyzer tuning presents another limitation.

Accordingly, a need exists in the art to provide an alternative way of reducing the spherical TOF aberrations T|zz, which can be used in planar or hollow cylindrical MR-TOF MS with densely folded ion trajectories and can provide for technical simplicity and decoupling of tuning of ion-optical properties in y- and z-directions.

SUMMARY

One aspect of the disclosure provides a multi-reflecting time-of-flight mass spectrometer. The spectrometer includes two electrostatic ion mirrors, a set of periodic lenses, a pulsed ion source or pulsed ion converter, an ion receiver, and at least one electrode structure. The ion mirrors extend along a drift direction. The set of periodic lenses is disposed between the mirrors. The pulsed ion source or pulsed ion converter forms ion bunches, which travel along ion trajectories. The ion receiver receives the ion bunches. At least one electrode structure is disposed in the pathway of the ion trajectories and forms at least one of an accelerating electrostatic fields or a reflecting electrostatic field. The accelerating or reflecting electrostatic field provides local negative flight time aberration in the drift direction. The ion trajectories form multiple reflections between the ion mirrors and pass through said set of period lenses.

Implementations of the disclosure may include one or more of the following features. In some implementations, the electrostatic ion mirrors may be planar. In other implementations, the electrostatic ion mirrors may be hollow cylindrical.

In some implementation, the multi-reflecting time-of-flight mass spectrometer includes an orthogonal accelerator with a curved accelerating field. Some examples may include an orthogonal accelerator that includes a lens that enlarges the size of the ion bunches as compared to the size of the incoming continuous ion beam. Other examples may include an orthogonal accelerator that includes a lens that focuses ion bunches in the drift direction to the turning point of the ion bunch at first reflection at the electrostatic ion mirrors.

Another aspect of the disclosure provides that the electrode structure is a single ion reflector or a single local distortion, which is disposed either at the location of ion mirrors' first reflection or at the location of the ion mirrors' final ion reflection. The multi-reflecting time-of-flight mass spectrometer may further include an ion mirror field curvature arranged by ion mirror edges in the drift direction.

In some implementations, the electrode structure includes a curved electrode that converts the ion bunches to secondary electrons. Additionally, the electrode structure may include a focusing field that redirects the ion trajectories. Or the electrode structure may be disposed within pulsed axial ion bunching of the ion trajectories to form an accelerating field in the drift direction. Additionally, the electrode structure may be arranged within an electrostatic sector of either the isochronous curved inlet or the energy filter. And the electrode structure may include an accelerator with static curved field.

Yet another aspect of the disclosure provides a method of mass spectrometric analysis. The method includes forming a pulsed ion packet within a pulsed ion source or a pulsed converter. The method also includes arranging multi-reflecting ion trajectories by reflecting ions between electrostatic fields of gridless ion mirrors. The ion mirrors are extended along a drift direction. The method also includes confining the ion packets along the multi-reflecting ion trajectories by spatially focusing fields of periodic lenses. The method also includes compensating for spherical time-of-flight aberrations created by the fields of periodic lenses utilizing local fields. The local fields are curved in the drift direction and are either accelerating or reflecting ions.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 5 is an xz-sectional view of the pulsed converter of FIG. 4;

FIG. 5A is a table providing the voltage applied, for an ion energy of 4100 eV, at the electrodes of the pulsed converter of FIG. 5.

FIG. 6 is a schematic view of a planar MR-TOF MS including a pulsed orthogonal accelerator with injection of the continuous ion beam in the drift z-direction according to another exemplary embodiment of the invention;

Like reference symbols in the various drawings indicate like elements.

DETAILED DESCRIPTION

Figure 1:
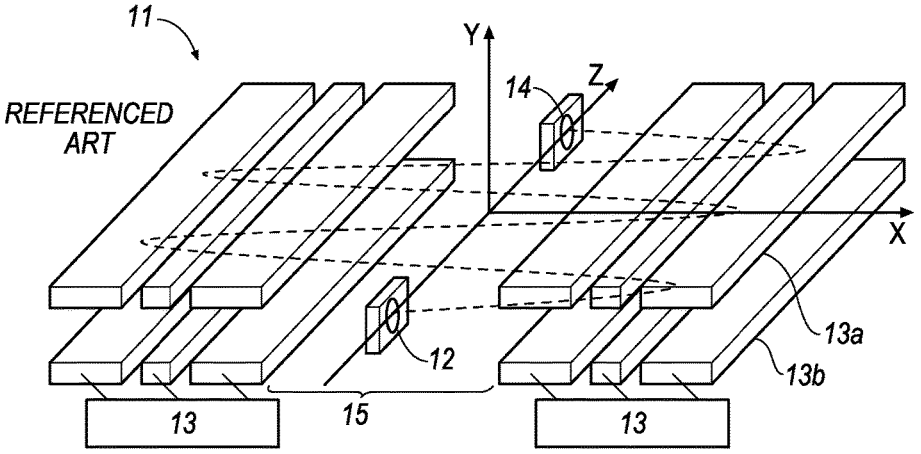
FIG. 1 is a schematic view of a planar multi-reflecting time-of-flight mass spectrometer (MR-TOF MS) as previously known in the art (e.g., SU1725289 by Nazarenko et. al)

Referring to FIG. 1, folded-path, planar MR-TOF MS 11 are described in the referenced art—e.g., Russian patent SU1725289—by Nazarenko, et. al.

The known MR-TOF MS 11 of FIG. 1 comprises two gridless electrostatic mirrors, each composed of three electrodes 13. Each electrode is made of a pair of parallel plates 13*a* and 13*b*, which are symmetric with respect to the central xz-plane. A source 12 and receiver 14 are located in the drift space 15 between the ion mirrors. The mirrors provide multiple ion reflections.

The known MR-TOF MS 11 of FIG. 1 provides no ion focusing in the shift z-direction. This lack of z-directional focusing functionally limits the number of reflection cycles traveled between the source 12 and the receiver 14.

Figure 2:
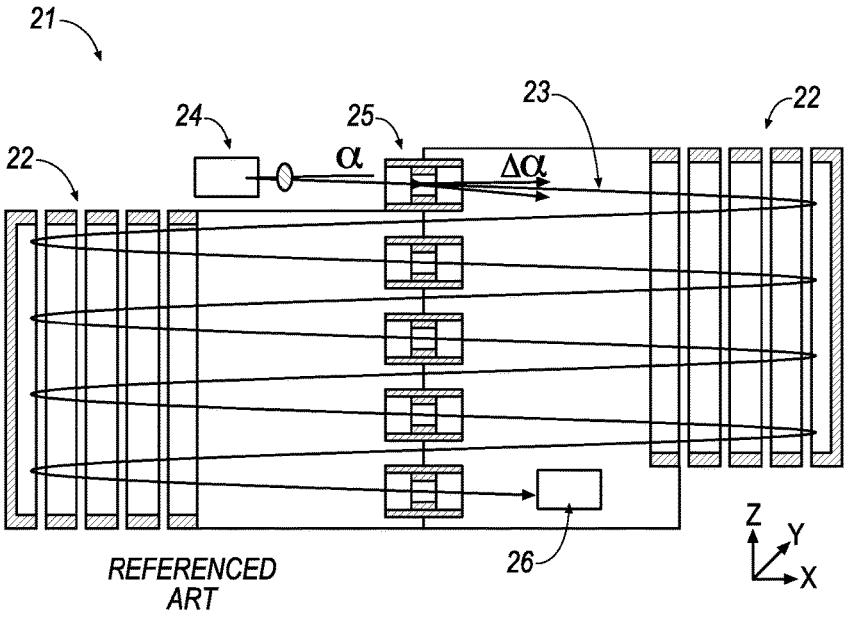
FIG. 2 is a schematic view of a planar MR-TOF MS with periodic lenses as previously known in the art (e.g., WO2005001878)

Referring to FIG. 2, planar MR-TOF MS 21 with periodic lenses 25 are described in the referenced art—e.g., the WO2005001878 publication—by the present inventors.

The known MR-TOF MS 21 of FIG. 2 comprises two parallel and planar ion mirrors 22. A set of periodic lenses 25 is disposed within the field free region between the ion mirrors 22. Ion bunches are ejected from a source 24 at small angle $\alpha$ to the x-axis. Ions are reflected between the ion mirrors 22 while slowly drifting along the trajectories 23 in the z-direction until the trajectories 23 reach the detector 26.

The mean angle $\alpha$ is selected such that the z-directional advance between each reflection coincides with the period of the periodic lenses 25. These periodic lenses 25 focus ions in the z-direction, providing for spatial confinement of ion bunches along the prolonged flight paths.

Figure 3:
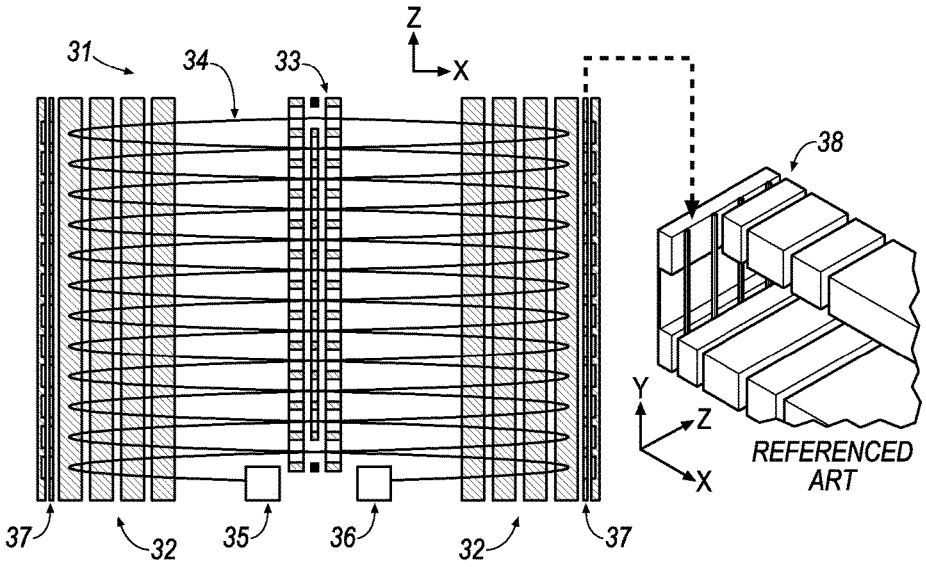
FIG. 3 is a schematic view of a quasi-planar MR-TOF MS as previously known in the art (e.g., US2011186729)

Referring to FIG. 3, quasi-planar MR-TOF MS 31 are described in the referenced art—e.g., the U.S. Patent Application No. 2011186729—by the present inventors.

The known MR-TOF MS 31 of FIG. 3 comprises two mirrors 32 extended in the z-direction, periodic lenses 33, and ion paths 34 starting from the pulsed ion source or converter 35 and ending at the detector 36. The two mirrors 32 comprise spatially modulated ion mirror fields 38 created by the incorporation of additional mask electrodes 37, which are disposed between the planar electrodes of the mirrors 32 and create periodic inhomogenieties (distortions) in the electrostatic field in the z-direction. Such periodic field distortions provide additional ion focusing in the z-direction. Each spatially modulated ion mirror field 38 can be tuned for negative T|zz aberrations, thus compensating positive T|zz of periodic lenses.

Efficient elimination of TOF aberrations in the known MR-TOF MS 31 of FIG. 3 requires the period of the electrostatic field inhomogeneity in the z-direction to equal or to exceed the y-height of the mirror window. To this end, only an impracticably large implementation of the MR-TOF MS 31 would efficiently eliminate TOF aberrations at the desirably dense levels of ion trajectory folding. So practical analyzer sizes cannot yield the desired flight path extension utilizing the known MR-TOF MS 31.

Referring to FIGS. 4-10, MR-TOF MS can yield the desired flight path extension by introducing one or more curved accelerating or reflecting fields providing negative T|zz to compensate for the positive T|zz aberrations of periodic lenses 44, 83. The curved accelerating or reflecting fields are optionally arranged within local areas of spatially restricted electrode sets to avoid systematic distortions caused by ion mirror fields. The electrode sets are preferably located at ion trajectory points before or after the ions pass through periodic lenses 44, 83.

In the local areas of spatially restricted electrode sets, the amplitudes of the induced flight time deviations sufficiently compensate for the TOF aberrations caused by the spatial z-spread of the ion packets.

As further illustrated in FIGS. 4-10, the negative flight time deviations, T|zz<0, can be provided by the following means: (i) forming a z-curved pulsed electric field within a pulsed accelerator, within a pulsed ion source, or within an axial dynamic ion buncher, (ii) forming a z-curved electrostatic field within the isochronous sector interface, (iii) forming a local z-curved field within the ion mirrors, preferably near the first or last point of ion reflection, of the MR-TOF analyzer, or (iv) at a curved converter of an ion detector.

Additionally, optimal compensation of the TOF aberrations caused by the spatial z-spread of the ion packets is optionally provided by implementing at least two of the local electrode sets between which the ion bunch phase space transforms in the z-direction.

Utilizing these design aspects, FIGS. 4-10 illustrate exemplary embodiments of the present disclosure's alternative methods of reducing the spherical TOF aberrations T|zz, which can be used in planar or hollow cylindrical MR TOF MS with densely folded ion trajectories and the present disclosure's technical simplicity and decoupling of tuning of ion-optical properties in y- and z-directions.

Figure 4:
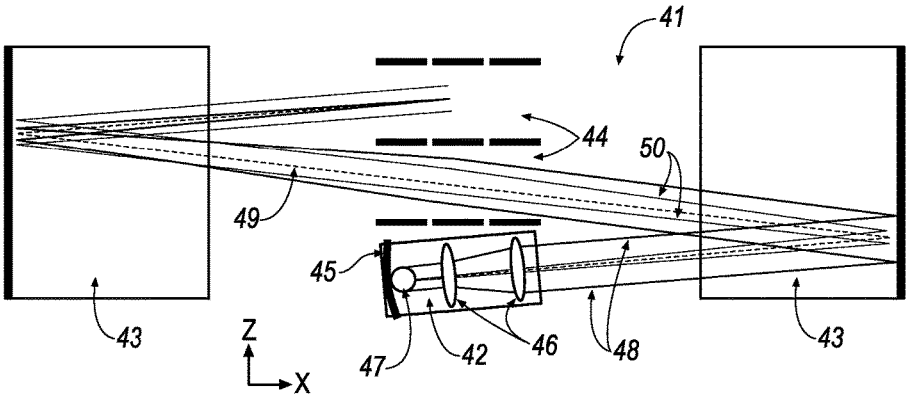
FIG. 4 is a schematic view of a planar MR-TOF MS including a pulsed orthogonal accelerator, which provides for a partial compensation of TOF T|zz aberrations according to an exemplary embodiment of the invention.

Referring specifically to FIG. 4, the planar MR-TOF MS 41 comprises a pulsed orthogonal accelerator shown as a pulsed converter 42 for orthogonal injection of ions into the TOF analyzer. The planar MR-TOF MS 41 also comprises two ion mirrors 43 and a set of periodic lenses 44, of which FIG. 4 depicts the first two (along the ion path).

The pulsed converter 42 comprises at least one z-curved electrode 45 creating an inhomogeneous accelerating field with the field curvature in the z-direction. The pulsed converter 42 preferably comprises electrodes creating electrostatic lens fields 46 which transform the space phase volume of the accelerated ions. The continuous ion beam 47 accelerates ions essentially perpendicular to the xz-plane. The ions flying in the inhomogeneous field created by the curved electrode 45 along the outer ion trajectories 48 reach the exit from the converter 42 faster than the ions flying along the central ion trajectory 49.

The electrostatic lens fields 46 enlarge the z-directional width of the ion bunch and, at the same time, reduce the angular spread in the accelerated bunch, which helps better coupling between the source emittance and the analyzer acceptance.

Referring to FIG. 5, the xz-section 51 of the pulsed converter 42 for ion orthogonal injection from the embodiment of the disclosure of FIG. 4 has been designed using the SIMION 8.1 program package. The pulsed converter 42 is gridless and comprises nine electrodes, to three of which pulsed voltages are applied.

Referring to FIG. 5A, the voltages applied at each of the nine electrodes shown in FIG. 5 are enumerated. The voltages enumerated correspond to an ion energy of 4100 eV.

A continuous ion beam 47 is injected into the pulsed converter 42 in the y-direction perpendicular to the plane of FIG. 5, between the electrodes #1 (push) and #2 (grounded). A negative deviation of the flight time for outer (in the z-direction) ion trajectories 48 in the accelerated bunch, as compared to the central ion trajectory 49, is provided by a z-curved structure of equi-potential lines 52 in the gap between these electrodes. With the typical initial beam diameter of two millimeters, the orthogonal accelerator provides a linear z-magnification equal to two and the negative deviation of the flight time for the outer ion trajectory 48, with respect to the central ion trajectory 49 of eight nanoseconds for ions having a 1000 a.m.u. mass. This eight nanosecond deviation is sufficient to compensate for the TOF aberration, T|zz, caused by a set of periodic lenses 44 in an planar MR TOF MS 41 with thirty full turns (created by sixty reflections at the ion mirrors 43) of ion bunches and the total flight time of 1.6 milliseconds for ions having a 1000 a.m.u. mass.

The inhomogeneous accelerating field creates a certain correlation between the z-position of the ion and its final energy, but the additional energy spread created by this correlation is only about one percent of the total energy spread in the accelerated ion bunch.

Referring back to FIG. 4, along the ion path passing in the planar MR TOF MS 41 through the periodic lenses 44, the TOF aberration, T|zz, is created because ions, flying along outer trajectories 48 and 50, which are offset from the central trajectory 49, have larger flight times than the ions flying along the central trajectory 49. Among those outer trajectories are the outer ion trajectories 48 that start from different points in the xz-plane at the continuous ion beam 47 and the outer ion trajectories 50 that start from one point in the xz-plane at the continuous ion beam 47 but at some angles with respect to the central trajectory 49. However, the inhomogeneous field of the pulsed converter 42 only compensates for the TOF aberration associated with the ions flying along the outer ion trajectories 48. The inhomogeneous field does not compensate for the ions flying along the outer ion trajectories 50.

Because the considered TOF aberration with respect to the spatial z-spread is proportional to the square of the amplitude of the oscillation of side trajectories with respect to the central one, the electrostatic lens fields 46 increases of the efficiency of compensation by increasing the spatial spread of outer ion trajectories 48 and by reducing the angular spread of outer ion trajectories 50. In this case the amplitude of oscillations of the outer ion trajectories 50 inside periodic lenses 44 is smaller than the amplitude of oscillations of the outer ion trajectories 48, and the pulsed converter 42 compensates for the major part of the TOF aberration with respect to the spatial z-spread of ions.

Referring to FIG. 6, the planar MR-TOF MS 61 comprises a pulsed orthogonal accelerator, shown as a pulsed converter 42, with injection of a continuous ion beam 47 in the drift z-direction. The planar MR-TOF MS 61 is similar to its counterpart in FIG. 4, but the planar MR-TOF MS 61 uses injection of the continuous beam 47 into the pulsed converter 42 for orthogonal injection, in the z-direction, of ions into the TOF analyzer.

The planar MR-TOF MS 61 of FIG. 6 also comprises two ion mirrors 43 and the first (along the ion path) periodic lens 44. The pulsed converter 42 comprises a z-curved electrode 45 creating an inhomogeneous accelerating field with the field curvature in the z-direction.

The pulsed converter 42 preferably comprises electrodes creating one or more electrostatic lens fields 46 which provides for a weak focusing of a wide ion beam 48.

Figure 7:
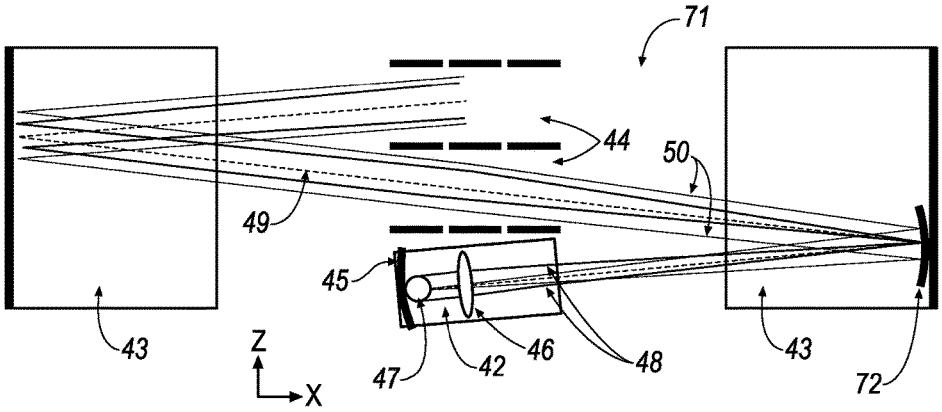
FIG. 7 is a schematic view of a planar MR-TOF MS including two local areas of the inhomogeneous fields, one in the orthogonal ion accelerator and the other near the ion turning point in the mirror, which compensate for the TOF T|zz aberrations according to another exemplary embodiment of the invention.

Referring to FIG. 7, the planar MR-TOF MS 71 comprises two local areas of the inhomogeneous fields that compensate for the TOF T|zz aberrations. The first local area is shown as a z-curved electrode in the pulsed converter 42. The second local areas is shown as a z-curved electrode 72 near the ion turning point in the ion mirror 43.

FIG. 7 illustrates a planar MR-TOF MS 71 comprising a pulsed converter 42 for orthogonal injection of ions into the TOF analyzer, two ion mirrors 43, the first two periodic lenses 44, and the local electrode 72 implemented in the mirror 43 near the first turning point of the ions.

The pulsed converter 42 comprises at least one electrode 45 creating a curved electrostatic field near the position of the continuous ion beam 47 and the focusing lens field 46. In operation, the lens field 46 focuses outer ion trajectories 48, maintaining the continuous ion beam 47 parallel to the central ion trajectory 49, to the position of the ion bunch turning point at first reflection from the mirror 43.

The inhomogeneous field created by electrode 45 is tuned to compensate the TOF aberration created by the spatial z-spread of ions in the outer ion trajectories 48, whereas the inhomogeneous field created by the local electrode 72 is tuned to compensate the TOF aberration due to the spatial z-spread of ions in the outer in trajectories 50. Thus, the planar MR TOF MS 71 achieves the full compensation of the TOF aberration with respect to the spatial z-spread of the ions.

In practical implementation, the local inhomogeneous field near the first ion bunch turning point in the mirror 43 can be created preferably by a local mask electrode or by the fringing field at the z-edge of the ion mirror nearest to the turning point.

Figure 8:
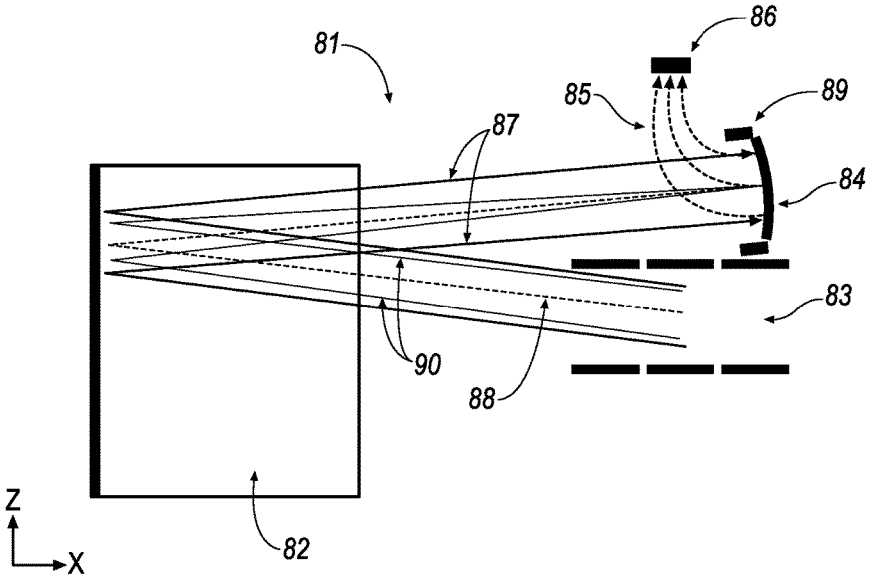
FIG. 8 is a schematic view of a planar MR-TOF MS including a detector with a curved surface for ion to electron conversion according to another exemplary embodiment of the invention.

Referring to FIG. 8, the planar MR-TOF MS 81 comprises a detector with a curved surface 84 for ion to electron conversion. Compensation of the TOF aberrations due to the spatial ion spread in the z-direction occurs in the ion detector with a curved surface 84.

Ion bunches within the MR-TOF MS 81 of FIG. 8 experience the last reflection from the mirror 82 after passing through the final periodic lens 83. The ions hit a surface 84 from which secondary electrons 85 are emitted. A secondary electron multiplier 86 records the secondary electrons 84 after the secondary electrons 84 deflect through a weak magnetic field. Due to a curvature of the surface 84, ions that come to the surface 84 along offset ion trajectories 87 acquire a negative deviation of the flight time which compensates for the larger flight times of these ions on the offset trajectory 87, compared with the flight times of ions flying along the central ion trajectory 88, The larger flight times for ions on the offset trajectories 87 are created in the periodic lenses 83.

In one example, to compensate for a positive flight time deviation of five nanoseconds for ions a mass of 1000 a.m.u. with the kinetic energy of 4000 eV and the offset from the central trajectory of two millimeters, the radius of the surface curvature should be 15.5 millimeters.

Preferably, to make the compensating TOF deviation tunable, a set of additional electrodes 89 can be arranged around the curved surface 84.

The considered curved surface 84 cannot compensate for the flight time aberration due to the spatial z-spread for offset trajectories 90 in FIG. 8, which come to the same point of the detector surface 84 at different angles. To eliminate this drawback, yet another preferred embodiment is shown in FIG. 9.

Figure 9:
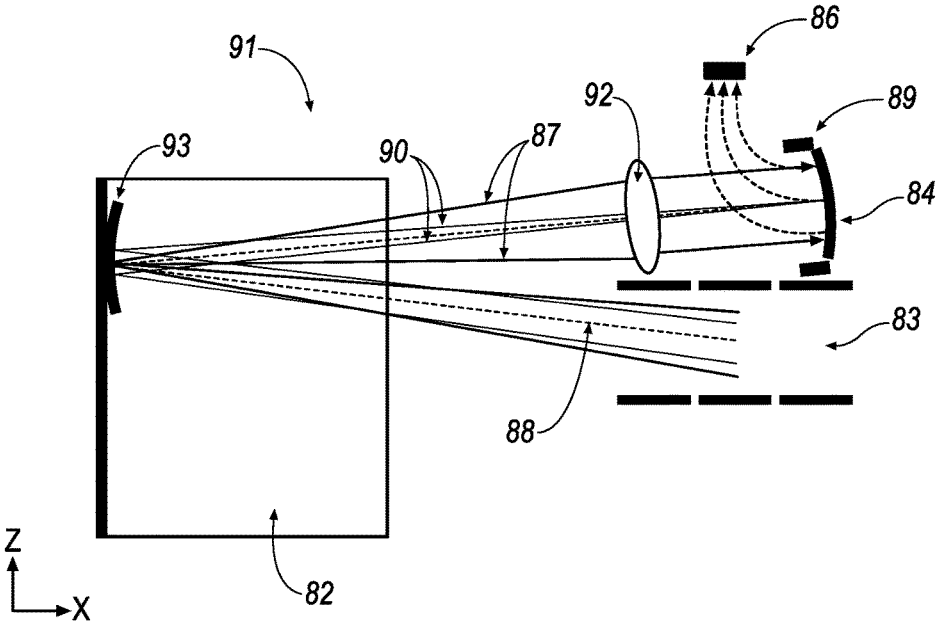
FIG. 9 is a schematic view of a planar MR-TOF MS including two local areas of the inhomogeneous fields, one in the detector and the other near the ion turning point in the mirror, which compensate for the TOF T|zz aberrations according to another exemplary embodiment of the invention.

Referring to FIG. 9, the planar MR-TOF MS 91 comprises two local areas of the inhomogeneous fields compensating the TOF T|zz aberration. The first local area is shown in the detector surface 84. The second local area is shown as a local electrode 93 near the ion turning point in the mirror 82.

In the planar MR-TOF MS 91, electrodes creating a focusing field 92 are implemented in front of the detector, and an additional local electrode is implemented in the mirror 82 near the turning points of the ions at their last reflection. The focusing system makes parallel the offset ion trajectories 87 coming from a single point at the turning point area.

In planar MR-TOF MS 91, the combination of the compensating means 84 and 93 can be tuned such that the curved electrode 84 compensates for the TOF aberration due to the spatial z-spread for offset ion trajectories 87, coming to the detector with different offsets from the central trajectory 88, and the compensating means 93 compensates the TOF aberrations for offset ion trajectories 90 coming to the same point at the detector under different angles.

Figure 10:
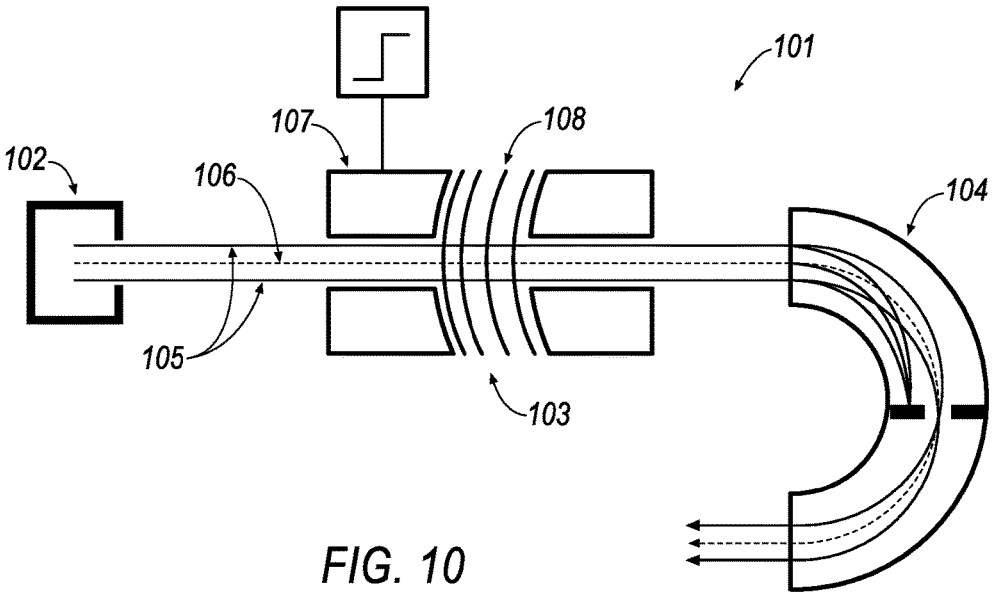
FIG. 10 is a schematic view of a MR-TOF MS including a continuous ion source, a dynamic energy buncher, and an energy filter according to another exemplary embodiment of the invention.

Short ion bunches for flight time analysis in MR TOF MS can be created from a continuous ion beam by an axial dynamic bunching of ions in a continuous ion beam with a subsequent energy filtering of ion energy spread. Functionally similar the orthogonal pulsed ion converter shown in FIGS. 4-5, a negative deviation of the flight time for ions flying off the central ion trajectory can be created in a dynamic bunching field. FIG. 10 illustrates the part of a MR-TOF MS 101 comprising a continuous ion source 102, a dynamic energy buncher 103, and an energy filter 104.

To induce a negative flight time deviation for ions 105 flying off the central trajectory 106, at least one electrode (preferably the pulsed one 107) of the buncher is curved so that the equi-potentials 108 of the pulsed bunching field are also curved.

Similar to the orthogonal ion injection of FIG. 5, the pulsed bunching field of the MR-TOF MS 101 of FIG. 10 creates a certain correlation between the final ion energy and the z-position of the ion, but the additional energy spread is small in comparison to the total energy spread in the ion bunch. Thus, the created energy spread does not deteriorate performance of the MR TOF MS 101.

An additional negative flight time deviation for ions flying off the central trajectory 106 can be provided in the energy filter 104, because it is well known from the general ion-optical theory that both sector field and mirror-type devices can provide for a negative TOF aberration with respect to the spatial spread in the ion beam.

A number of implementations have been described. Nevertheless, it will be understood that various modifications may be made without departing from the spirit and scope of the disclosure. Accordingly, other implementations are within the scope of the following claims.

What is claimed is:

1. A multi-reflecting time-of-flight mass spectrometer comprising:

two electrostatic ion mirrors extended along a drift direction;

a set of periodic lenses disposed between said mirrors;

a pulsed ion source or pulsed converter forming ion bunches traveling along ion trajectories;

an ion receiver for receiving said ion bunches;

at least one electrode structure disposed in a pathway of said ion trajectories, wherein said ion trajectories form multiple reflections between said ion mirrors and pass through said set of periodic lenses, wherein the at least one electrode structure forms at least one of an accelerating electrostatic field or a reflecting electrostatic field providing local negative flight time aberration in said drift direction;

wherein the at least one electrode structure comprises an orthogonal accelerator, wherein the orthogonal accelerator comprises a curved accelerating field with a curvature of the field being in the drift direction, and wherein said electrode structure comprises a single ion reflector or a local distortion, and wherein said ion reflector or local distortion is disposed either at a location of a first reflection by said ion mirrors or at a location of a final ion reflection by said ion mirrors.

2. The multi-reflecting time-of-flight mass spectrometer of claim 1, wherein said electrostatic ion mirrors are planar.

3. The multi-reflecting time-of-flight mass spectrometer of claim 1, wherein said electrostatic ion mirrors are hollow cylindrical.

4. The multi-reflecting time-of-flight mass spectrometer of claim 1, wherein said orthogonal accelerator further comprises a lens which enlarges a drift-directional size of said ion bunches as compared to a drift-directional size of an incoming continuous ion beam.

5. The multi-reflecting time-of-flight mass spectrometer of claim 1, wherein said orthogonal accelerator further comprises a lens which focuses ion bunches in said drift direction to a turning point of the ion bunch at first reflection at either of said two electrostatic ion mirrors.

6. The multi-reflecting time-of-flight mass spectrometer of claim 1, wherein said ion mirror field curvature is arranged by ion mirror edges in the drift direction.

7. The multi-reflecting time-of-flight mass spectrometer of claim 1, wherein said at least one electrode structure comprises a curved electrode, and wherein said curved electrode converts said ion bunches to secondary electrons.

8. The multi-reflecting time-of-flight mass spectrometer of claim 7, wherein said at least one electrode structure further comprises a focusing field, wherein said focusing field redirects said ion trajectories.

9. The multi-reflecting time-of-flight mass spectrometer of claim 1 wherein said at least one electrode structure is arranged within pulsed axial ion bunching of said ion trajectories to form an accelerating field in the drift direction.

10. The multi-reflecting time-of-fight mass spectrometer of claim 9, wherein said at least one electrode structure is arranged within an electrostatic sector of either an isochronous curved inlet or an energy filter.

11. The multi-reflecting time-of-flight mass spectrometer of claim 10, further comprising an accelerator with static curved field.

12. A method of mass spectrometric analysis comprising the following steps:

forming a pulsed ion packet within a pulsed ion source or a pulsed converter, wherein the pulsed ion source or the pulsed converter comprise a curved accelerating field with a curvature of the field being in a drift direction;

arranging multi-reflecting ion trajectories by reflecting ions between electrostatic fields of gridless ion mirrors, wherein said ion mirrors are extended along the drift direction;

confining said ion packets along said multi-reflecting ion trajectories by spatially focusing fields of periodic lenses;

compensating for spherical time-of-flight aberrations created by said fields of periodic lenses utilizing local fields, wherein said local fields are curved in said drift direction and are either accelerating or reflecting ions; and converting said ion packets to secondary electrons with a curved electrode.

13. A multi-reflecting time-of-flight mass spectrometer comprising:

two electrostatic ion mirrors extended along a drift direction;

a set of periodic lenses disposed between said mirrors;

a pulsed ion source or pulsed converter forming ion bunches traveling along ion trajectories;

an ion receiver for receiving said ion bunches; and at least one electrode structure disposed in a pathway of said ion trajectories, wherein said ion trajectories form multiple reflections between said ion mirrors and pass through said set of periodic lenses, wherein the at least one electrode structure forms at least one of an accelerating electrostatic field or a reflecting electrostatic field providing local negative flight time aberration in said drift direction;

wherein the at least one electrode structure comprises an orthogonal accelerator, wherein the orthogonal accelerator comprises a curved accelerating field with a curvature of the field being in the drift direction, and wherein said at least one electrode structure comprises a curved electrode, and wherein said curved electrode converts said ion bunches to secondary electrons.

14. A multi-reflecting time-of-flight mass spectrometer comprising:

two electrostatic ion mirrors extended along a drift direction;

a set of periodic lenses disposed between said mirrors;

a pulsed ion source or pulsed converter forming ion bunches traveling along ion trajectories;

an ion receiver for receiving said ion bunches; and at least one electrode structure disposed in a pathway of said ion trajectories, wherein said ion trajectories form multiple reflections between said ion mirrors and pass through said set of periodic lenses, wherein the at least one electrode structure forms at least one of an accelerating electrostatic field or a reflecting electrostatic field providing local negative flight time aberration in said drift direction;

wherein the at least one electrode structure comprises an orthogonal accelerator, wherein the orthogonal accelerator comprises a curved accelerating field with a curvature of the field being in the drift direction, and wherein said at least one electrode structure is arranged within pulsed axial ion bunching of said ion trajectories to form an accelerating field in the drift direction.

* * * * *